US007361235B2

(12) United States Patent
Ohtsuka et al.

(10) Patent No.: US 7,361,235 B2
(45) Date of Patent: Apr. 22, 2008

(54) METHOD FOR PRODUCING DISPERSED OXIDE REINFORCED FERRITIC STEEL HAVING COARSE GRAIN STRUCTURE AND BEING EXCELLENT IN HIGH TEMPERATURE CREEP STRENGTH

(75) Inventors: Satoshi Ohtsuka, Higashi-Ibaraki-gun (JP); Shigeharu Ukai, Higashi-Ibaraki-gun (JP); Takeji Kaito, Higashi-Ibaraki-gun (JP); Masayuki Fujiwara, Kobe (JP)

(73) Assignee: Japan Nuclear Cycle Development Institute, Ibaraki (JP)

( * ) Notice: Subject to any disclaimer, the term of this patent is extended or adjusted under 35 U.S.C. 154(b) by 0 days.

(21) Appl. No.: 10/501,673

(22) PCT Filed: Aug. 7, 2003

(86) PCT No.: PCT/JP03/10082

§ 371 (c)(1),
(2), (4) Date: Jul. 16, 2004

(87) PCT Pub. No.: WO2004/024968

PCT Pub. Date: Mar. 25, 2004

(65) Prior Publication Data

US 2005/0042127 A1 Feb. 24, 2005

(30) Foreign Application Priority Data

Aug. 8, 2002 (JP) ..... 2002-231781

(51) Int. Cl.
*H01F 1/055* (2006.01)
*C21D 7/13* (2006.01)
*C22C 1/08* (2006.01)

(52) U.S. Cl. ..... 148/122; 148/609; 148/653; 419/29; 419/46

(58) Field of Classification Search ..... 419/19, 419/20, 32, 41
See application file for complete search history.

(56) References Cited

U.S. PATENT DOCUMENTS 4,075,010 A * 2/1978 Fischer ..... 75/235
4,464,207 A * 8/1984 Kindlimann ..... 148/207
4,963,200 A * 10/1990 Okuda et al. ..... 148/325
5,591,391 A * 1/1997 Igarashi et al. ..... 420/38
6,485,584 B1 * 11/2002 Lambard et al. ..... 148/514

FOREIGN PATENT DOCUMENTS

EP 0 949 346 10/1999

(Continued)

OTHER PUBLICATIONS

Nofant Trionix transparent iron oxide pigments, www.novantchemcials.com, Apr. 8, 2004.*

(Continued)

*Primary Examiner*—Roy King
*Assistant Examiner*—Tima M McGuthry-Banks
(74) *Attorney, Agent, or Firm*—Wenderoth, Lind & Ponack, L.L.P.

(57) ABSTRACT

A method of manufacturing an oxide dispersion strengthened ferritic steel excellent in high-temperature creep strength having a coarse grain structure. The method comprises mixing alloy powders and an $Y_2O_3$ powder, subjecting the mixed powder to mechanical alloying treatment, solidifying the alloyed powder by hot extrusion, and subjecting the extruded solidified material to final heat treatment involving heating to and holding at a temperature of not less than the $Ac_3$ transformation point and slow cooling at a rate of not more than a ferrite-forming critical rate which comprises, 0.05-0.25% C, 8.0-12.0% Cr, 0.1-4.0% W, 0.1-1.0% Ti, 0.1-0.5% $Y_2O_3$ by weight, with the balance being Fe. In this method, by using a $TiO_2$ powder as a Ti component to be mixed at the mechanical alloying treatment or by adding a $Fe_2O_3$ powder, the bonding of Ti with C is suppressed, and the C concentration in the matrix does not decrease.

2 Claims, 4 Drawing Sheets

FOREIGN PATENT DOCUMENTS

| | | | |
|---|---|---|---|
| FR | 2777020 | * | 10/1999 |
| JP | 56044716 | * | 4/1981 |
| JP | 63210299 | * | 8/1988 |
| JP | 5051709 | * | 3/1993 |
| JP | 11/343526 | | 12/1999 |

OTHER PUBLICATIONS

Metals Handbook, Desk Edition, 2nd Edition, 1998, p. 41.*
English abstracts of FR 2777020.*
English abstract of JP 63210299.*
English abstract of JP 56044716.*
English abstract of JP 5051709.*
Metals Handbook, Desk Edition, 2nd Edition, ASM International, 1998, p. 53.*
Ukai et al., Development of Oxide Dispersion Strengthened Steels for FBR Core Application, (II) Morphology Improvement by Martensite Transformation, Journal of Nuclear Science and Technology, vol. 35, No. 4, pp. 294-300, (Apr. 1998).
Asabe et al. The Development of a Metal Matrix Composite by Mechanical Alloying, The Sumimoto Search, No. 45, pp. 65-72 (Mar. 1991).

* cited by examiner

T5

T6

T7

METHOD FOR PRODUCING DISPERSED OXIDE REINFORCED FERRITIC STEEL HAVING COARSE GRAIN STRUCTURE AND BEING EXCELLENT IN HIGH TEMPERATURE CREEP STRENGTH

TECHNICAL FIELD

The present invention relates to a method of manufacturing an oxide dispersion strengthened ferritic steel excellent in high-temperature creep strength and, more particularly, to a method of manufacturing an oxide dispersion strengthened ferritic steel to which excellent high-temperature creep strength can be imparted by adjusting an excess oxygen content in steel, thereby to form a coarse grain structure.

The oxide dispersion strengthened ferritic steel of the present invention can be advantageously used as a fuel cladding tube material of a fast breeder reactor, a first wall material of a nuclear fusion reactor, a material for thermal power generation, etc. in which strength at high temperatures is particularly required.

BACKGROUND ART

Although austenitic stainless steels have hitherto been used in the components of nuclear reactors, especially fast reactors which are required to have excellent high-temperature strength and resistance to neutron irradiation, they have limitations on irradiation resistance such as swelling resistance. On the other hand, ferritic stainless steels have the disadvantage of low high-temperature strength although they are excellent in irradiation resistance.

Therefore, oxide dispersion strengthened ferritic steels in which fine oxide particles are dispersed have been proposed as materials excellent in irradiation resistance and high-temperature strength. It is also known that in order to improve the strength of the oxide dispersion strengthened ferritic steels, it is effective to further finely disperse the oxide particles by adding Ti to the steels.

In particular, for improving the high-temperature creep strength of oxide dispersion strengthened ferritic steels, it is effective to make grain coarse and equiaxed in order to suppress grain-boundary slidings. As a method of obtaining such a coarse grain structure, there has been proposed, for example, a method wherein a sufficient amount of $\alpha$ to $\gamma$ transformation is ensured by performing austenitization heat treatment which involves heating to a temperature of not less than the $Ac_3$ transformation point and holding at this temperature, thereby causing austenitization to occur by phase transformation from $\alpha$-phase to $\gamma$-phase, and after that, slow cooling is performed at a sufficiently low rate, i.e., at a rate of not more than the ferrite-forming critical rate so that a ferrite structure can be obtained by phase transformation from $\gamma$-phase to $\alpha$-phase (refer to, for example, the Japanese Patent Laid-Open No. 11-343526/1999).

However, in the case where Ti is added to an oxide dispersion strengthened ferritic steel, there occurs a problem that Ti combines with C in the matrix to form a carbide, with the result that the C concentration in the matrix decreases and hence it is impossible to ensure a sufficient amount of $\alpha$ to $\gamma$ transformation during austenitization heat treatment.

Namely, as described above, the heat treatment of an oxide dispersion strengthened ferritic steel to obtain a coarse grain structure involves slow cooling at a rate of not more than the ferrite-forming critical rate after obtaining $\gamma$-phase by performing austenitization heat treatment which involves heating to a temperature of not less than the $Ac_3$ transformation point and holding at this temperature. However, since Ti has a strong affinity for C which is a $\gamma$-phase-forming element in the matrix, Ti and C combine to form a carbide. As a result, the C concentration in the matrix decreases, and a single phase of $\gamma$-phase is not formed even by the heat treatment at a temperature of not less than the $Ac_3$ transformation point and untransformed $\alpha$-phase is retained. For this reason, even when slow cooling is performed from $\gamma$-phase at a rate of not more than the ferrite-forming critical rate, for example, at a rate of not more than 100° C./hour, it follows that, due to the presence of retained a-phase, the a-phase which has transformed from $\gamma$-phase becomes a fine grain structure. Such a fine grain structure does not contribute to an improvement in high-temperature strength.

DISCLOSURE OF THE INVENTION

An object of the present invention is, therefore, to provide a method of manufacturing an oxide dispersion strengthened ferritic steel having a coarse grain structure effective in improving high-temperature creep strength in which sufficient $\alpha$ to $\gamma$ transformation during heat treatment is ensured by suppressing the bonding of Ti with C thereby to maintain the C concentration in the matrix even when Ti is added to the oxide dispersion strengthened ferritic steel.

According to the present invention, there is provided a method of manufacturing an oxide dispersion strengthened ferritic steel excellent in high-temperature creep strength having a coarse grain structure, said method comprising mixing either element powders or alloy powders and a $Y_2O_3$ powder, subjecting the mixed powder to mechanical alloying treatment, subjecting the resulting alloyed powder to hot extrusion, and subjecting the resulting extruded material to final heat treatment involving heating to and holding at a temperature of not less than the $Ac_3$ transformation point and slow cooling at a rate of not more than a ferrite-forming critical rate to thereby manufacture an oxide dispersion strengthened ferritic steel which comprises, as expressed by % by weight, 0.05 to 0.25% C, 8.0 to 12.0% Cr, 0.1 to 4.0% W, 0.1 to 1.0% Ti, 0.1 to 0.5% $Y_2O_3$ with the balance being Fe and unavoidable impurities and in which $Y_2O_3$ particles are dispersed in the steel, wherein a $TiO_2$ powder is used as an element powder of a Ti component to be mixed at the mechanical alloying treatment.

Incidentally, in the following descriptions of this specification, "%" always denotes "% by weight".

In the present invention as described above, by using a $TiO_2$ powder, which is an oxide, in place of a metal Ti powder as a raw material powder, it is possible to beforehand prevent Ti from combining with C to form a carbide and, therefore, the C concentration in the matrix is not lowered. As a result, it is possible to cause a sufficient $\alpha$ to $\gamma$ transformation to occur during the heat treatment at a temperature of not less than the $Ac_3$ transformation point to thereby form a single phase of $\gamma$-phase, and it is possible to form $\alpha$-phase having a coarse grain structure,by performing the succeeding heat treatment of slow cooling at a rate of not more than a ferrite-forming critical rate, whereby high-temperature creep strength can be improved.

Furthermore, the present invention provides a method of manufacturing an oxide dispersion strengthened ferritic steel excellent in high-temperature creep strength having a coarse grain structure, said method comprising mixing either element powders or alloy powders and a $Y_2O_3$ powder, subjecting the mixed powder to mechanical alloying treatment, subjecting the resulting alloyed powder to hot extrusion, and subjecting the resulting extruded material to final heat treatment involving heating to and holding at a temperature of not less than the $Ac_3$ transformation point and slow cooling at a rate of not more than a ferrite-forming critical rate to thereby manufacture an oxide dispersion strengthened ferritic steel which comprises, as expressed by % by weight, 0.05 to 0.25% C, 8.0 to 12.0% Cr, 0.1 to 4.0% W, 0.1 to 1.0% Ti, 0.1 to 0.5% $Y_2O_3$ with the balance being Fe and unavoidable impurities and in which $Y_2O_3$ particles are dispersed in the steel, wherein a $Fe_2O_3$ powder is additionally added as a raw material powder to be mixed at the mechanical alloying treatment so that an excess oxygen content in the steel (a value obtained by subtracting an oxygen content in $Y_2O_3$ from an oxygen content in steel) satisfies $$0.67Ti-2.7C+0.45>Ex.O>0.67Ti-2.7C+0.35$$

where Ex.0: excess oxygen content in steel, % by weight,

Ti: Ti content in steel, % by weight,

C: C content in steel, % by weight.

In the present invention as described above, by additionally adding an $Fe_2O_3$ powder, which is an unstable oxide, as a raw material powder so that the excess oxygen content in steel becomes within a predetermined range, Ti combines with excess oxygen to form an oxide without combining with C to form a carbide and, therefore, Ti does not lower the C concentration in the matrix. As a result, it is possible to cause a sufficient α to γ transformation to occur during the heat treatment at a temperature of not less than the $AC_3$ transformation point to thereby form a single phase of γ-phase, and it is possible to form α-phase having a coarse grain structure by performing the succeeding heat treatment of slow cooling at a rate of not more than a ferrite-forming critical rate, whereby high-temperature creep strength can be improved.

BEST MODE FOR CARRYING OUT THE INVENTION

Figure 1:
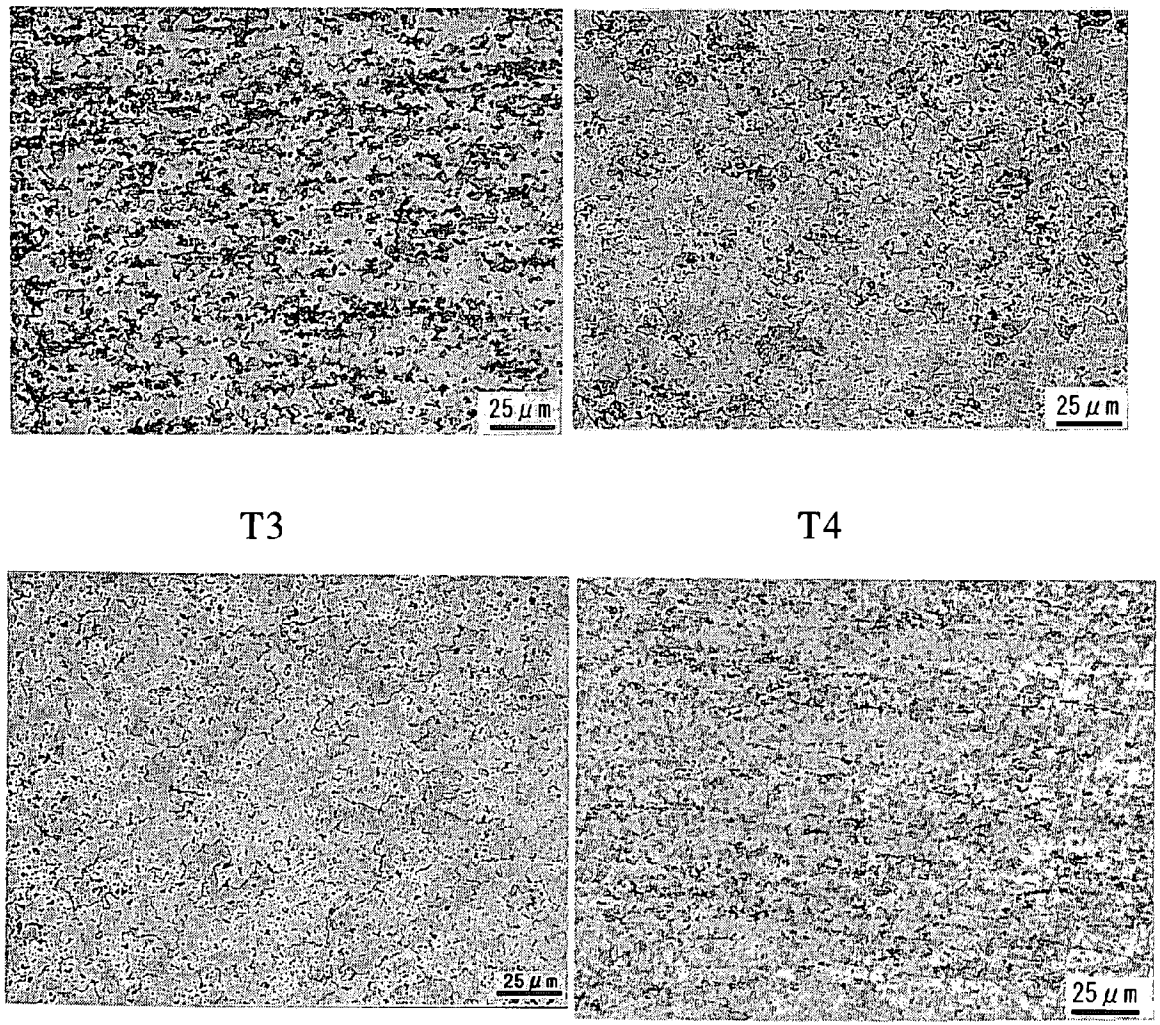
FIG. 1 is optical microphotographs of metallographic structures of the test materials T14, MM13, T3 and T4.

The chemical composition of the oxide dispersion strengthened ferritic steel of the invention and the reasons for the limitation of its compositions will be described below.

Cr (choromium) is an element important for ensuring corrosion resistance, and if the Cr content is less than 8.0%, the worsening of corrosion resistance becomes remarkable. If the Cr content exceeds 12.0%, a decrease in toughness and ductility is feared. For this reason, the Cr content should be 8.0 to 12.0%.

The C (carbon) content is determined for the following reason. In the present invention, an equiaxed and coarse grain structure is obtained by causing α to γ transformation to occur by heat treatment to a temperature of not less than the $Ac_3$ transformation point and succeeding slow cooling heat treatment. That is, in order to obtain an equiaxed and coarse grain structure, it is essential to cause α to γ transformation to occur by heat treatment.

When the Cr content is 8.0 to 12.0%, it is necessary that C is contained in an amount of not less than 0.05% in order to cause α to γ transformation to occur. This α to γ transformation occurs when heat treatment at 1000 to 1150° C. for 0.5 to 1 hour is performed. The higher the C content, the larger the amount of precipitated carbides ($M_{23}C_6$, $M_6C$, etc.) and the higher high-temperature strength will be. However, workability deteriorates when C is contained in an amount of not less than 0.25%. For this reason, the C content should be 0.05 to 0.25%.

W (tungsten) is an important element which dissolves into an alloy in a solid solution state to improve high-temperature strength, and is added in an amount of not less than 0.1%. A high W content improves creep rupture strength due to the solid-solution strengthening, the strengthening by carbide (($M_{23}C_6$, $M_6C$, etc.) precipitation and the strengthening by intermetallic compound precipitation. However, if the W content exceeds 4.0%, the amount of δ-ferrite increases and contrarily strength decreases. For this reason, the W content should be 0.1 to 4.0%.

Ti (titanium) plays an important role in the dispersion strengthening of $Y_2O_3$ and forms the complex oxide $Y_2Ti_2O_7$ or $Y_2TiO_5$ by reacting with $Y_2O_3$, thereby functioning to finely disperse oxide particles. This action tends to reach a level of saturation when the Ti content exceeds 1.0%, and the finely dispersing action is small when the Ti content is less than 0.1%. For this reason, the Ti content should be 0.1 to 1.0%.

$Y_2O_3$ is an important additive which improves high-temperature strength due to dispersion strengthening. When the $Y_2O_3$ content is less than 0.1%, the effect of dispersion strengthening is small and strength is low. On the other hand, when $Y_2O_3$ is contained in an amount exceeding 0.5%, hardening occurs remarkably and a problem arises in workability. For this reason, the. $Y_2O_3$ content should be 0.1 to 0.5%.

In a method of manufacturing an oxide dispersion strengthened ferritic steel according to the present invention, raw material powders, such as metal element powders or alloy powders and oxide powders, are mixed so as to obtain a target composition and alloyed by using what is called mechanical alloying treatment. After the resulting alloyed powder is filled in an extrusion capsule, degassing, sealing and hot extrusion are performed, whereby the alloyed powder is extruded, for example, into an extruded rod-shaped material.

The hot extruded rod-shaped material thus obtained is subjected to final heat treatment which involves heating to a temperature of not less than the $Ac_3$ transformation point and holding at this temperature, which is followed by slow cooling heat treatment at a rate of not more than the ferrite-forming critical rate. As the slow cooling heat treatment, it is usually possible to adopt furnace cooling heat treatment in which cooling is carried out slowly in a furnace. As the cooling rate of not more than the ferrite-forming critical rate, it is usually possible to adopt a rate not more than 100° C./hour, preferably not more than 50° C./hour.

In the case of the oxide dispersion strengthened ferritic steel of the invention, the $Ac_3$ transformation point is about 900 to 1200° C. When the C content is 0.13%, the $Ac_3$ transformation point is about 950° C.

In the present invention, as means of preventing the Ti in steel from combining with C to form a carbide and lower the C concentration in the matrix, it is possible to adopt a method in which a $TiO_2$ powder is used in place of a metal Ti powder as a raw material powder to be mixed at the mechanical alloying treatment. In this case, unlike Ti, $TiO_2$ does not combine with C, with the result that it is possible to suppress a decrease in the C concentration in the matrix. The amount of $TiO_2$ powder to be mixed may be within the range of 0.1 to 1.0% in terms of the Ti content.

Furthermore, in the present invention, as means of preventing the Ti in steel from combining with C to form a carbide and lower the C concentration in the matrix, it is also possible to adopt a method in which an $Fe_2O_3$ powder, which is an unstable oxide, is additionally added as a raw material powder to be mixed at the mechanical alloying treatment, thereby increasing the excess oxygen content in steel. In this case, since the Ti combines with the excess oxygen in steel derived from $Fe_2O_3$ to form an oxide without combining with C to form a carbide, it is possible to suppress a decrease in the C concentration in the matrix.

The amount of the $Fe_2O_3$ powder to be mixed is determined so that an excess oxygen content in steel satisfies $$0.67Ti-2.7C+0.45>Ex.O>0.67Ti-2.7C+0.35$$

where Ex.O: excess oxygen content in steel, % by weight,

Ti: Ti content in steel, % by weight,

C: C content in steel, % by weight.

The reason for setting the upper limit and lower limit to such an excess oxygen content will be described below.

Table 1 collectively shows the target compositions of test materials of oxide dispersion strengthened ferritic steel and the features of the compositions.

TABLE 1

| Test material No. | Target composition | Features of compositions |
|---|---|---|
| MM13 | 0.13C-9Cr-2W-0.20Ti-0.35$Y_2O_3$ | Basic composition |
| T14 | 0.13C-9Cr-2W-0.20Ti-0.35$Y_2O_3$ | Basic composition |
| T3 | 0.13C-9Cr-2W-0.20Ti-0.35$Y_2O_3$-0.17 $Fe_2O_3$ | Addition of $Fe_2O_3$ |
| T4 | 0.13C-9Cr-2W-0.50Ti-0.35$Y_2O_3$ | Increase of Ti |
| T5 | 0.13C-9Cr-2W-0.50Ti-0.35$Y_2O_3$-0.33 $Fe_2O_3$ | Increase of Ti Addition of $Fe_2O_3$ |
| T6 | 0.13C-9Cr-2W-0.125$TiO_2$-0.35$Y_2O_3$ | Addition of $TiO_2$ $TiO_2/Y_2O_3$ = 1/1 |
| T7 | 0.13C-9Cr-2W-0.25$TiO_2$-0.35$Y_2O_3$ | Addition of $TiO_2$ $TiO_2/Y_2O_3$ = 2/1 |

In each test material, either element powders or alloy powders and oxide powders were blended to obtain a target composition, charged into a high-energy attritor and thereafter subjected to mechanical alloying treatment by stirring in an Ar atmosphere of 99.99%. The number of revolutions of the attritor was about 220 rpm and the stirring time was about 48 hours. The resulting alloyed powder was filled in a capsule made of a mild steel, degassed at a high temperature in a vacuum, and then subjected to hot extrusion at about 1150 to 1200° C. in an extrusion ratio of 7 to 8:1, to thereby obtain a hot extruded rod-shaped material.

In Table 1, the test materials MM13 and T14 have a basic composition, T3 is a test material in which the excess oxygen content was increased by adding $Fe_2O_3$ to the basic composition of T14, and T4 is a test material in which the amount of added Ti was increased. T5 is a test material in which the amount of added Ti was increased and the excess oxygen content was increased by adding $Fe_2O_3$, and T6 and T7 are test materials in which Ti was added in the form of a chemically stable oxide ($TiO_2$) in amounts of 0.125% and 0.25%, respectively, to increase excess oxygen content.

Table 2 collectively shows the results of chemical analysis of each test material (hot extruded rod-shaped material) which was prepared as described above.

An excess oxygen content is a value obtained by subtracting an oxygen content in a dispersed oxide ($Y_2O_3$) from an oxygen content in a test material in the analysis results of the chemical components.

TABLE 2

| | Chemical compositions (wt %) | | | | | | | |
|---|---|---|---|---|---|---|---|---|
| Classification | C | Si | Mn | P | S | Ni | Cr | W |
| Target range of basic composition | 0.11~0.15 | <0.20 | <0.20 | <0.02 | <0.02 | <0.20 | 8.5~9.5 | 1.8~2.2 |
| Target value | 0.13 | — | — | — | — | — | 9.00 | 2.00 |
| MM13 | 0.14 | <0.005 | <0.01 | 0.001 | 0.003 | 0.01 | 8.82 | 1.94 |
| T14 | 0.14 | <0.005 | <0.01 | 0.002 | 0.003 | 0.04 | 8.80 | 1.96 |
| T3 | 0.13 | <0.005 | <0.01 | 0.002 | 0.003 | 0.01 | 8.75 | 1.93 |
| T4 | 0.13 | <0.005 | <0.01 | 0.002 | 0.003 | 0.01 | 8.72 | 1.93 |
| T5 | 0.13 | <0.005 | <0.01 | 0.002 | 0.003 | 0.01 | 8.75 | 1.93 |

TABLE 2-continued

| | | | | | | | | |
|---|---|---|---|---|---|---|---|---|
| T6 | 0.14 | <0.005 | <0.01 | 0.002 | 0.003 | 0.01 | 8.54 | 1.87 |
| T7 | 0.14 | <0.005 | <0.01 | 0.003 | 0.003 | 0.01 | 8.50 | 1.90 |

| | Chemical compositions (wt %) | | | | | | | |
|---|---|---|---|---|---|---|---|---|
| Classification | Ti | Y | O | N | Ar | $Y_2O_3$ | $TiO_2$ | Ex. 0 |
| Target range of basic composition | 0.18~0.22 | 0.26~0.29 | 0.15~0.25 | <0.07 | <0.007 | | | |
| Target value | 0.20 | 0.275 | 0.20 | — | — | | | |
| MM13 | 0.20 | 0.27 | 0.21 | 0.0093 | 0.005 | 0.343 | — | 0.137 |
| T14 | 0.21 | 0.26 | 0.18 | 0.013 | 0.005 | 0.330 | — | 0.110 |
| T3 | 0.21 | 0.27 | 0.22 | 0.012 | 0.005 | 0.343 | — | 0.147 |
| T4 | 0.46 | 0.27 | 0.18 | 0.009 | 0.005 | 0.343 | — | 0.107 |
| T5 | 0.46 | 0.27 | 0.24 | 0.011 | 0.005 | 0.343 | — | 0.167 |
| T6 | 0.09 | 0.27 | 0.24 | 0.011 | 0.005 | 0.343 | 0.150 | 0.167 |
| T7 | 0.14 | 0.27 | 0.29 | 0.014 | 0.006 | 0.343 | 0.234 | 0.217 |

These test materials were subjected to final heat treatment involving austenitization heat treatment (heating to and holding at a temperature of not less than the $Ac_3$ transformation point: 1050° C.×1 hr), which is followed by furnace cooling heat treatment (slow cooling heat treatment at a rate of not more than a ferrite-forming critical rate: slow cooling from 1050° C. to 600° C. at a rate of 37° C./hr).

Figure 2:
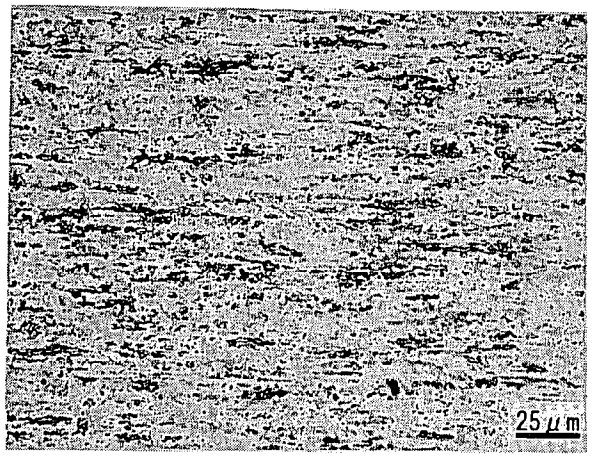
FIG. 2 is optical microphotographs of metallographic structures of the test materials T5, T6 and T7.
Figure 2:
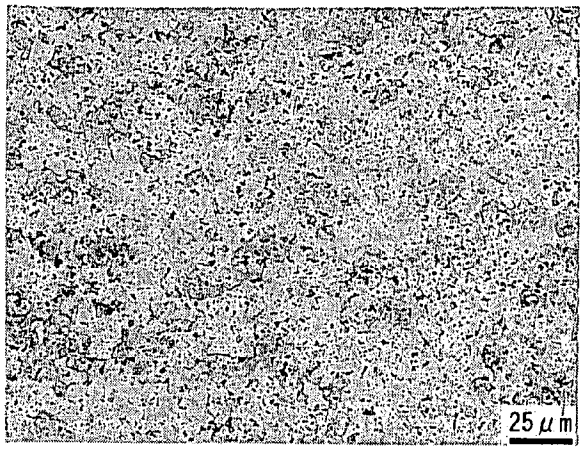
Figure 2:
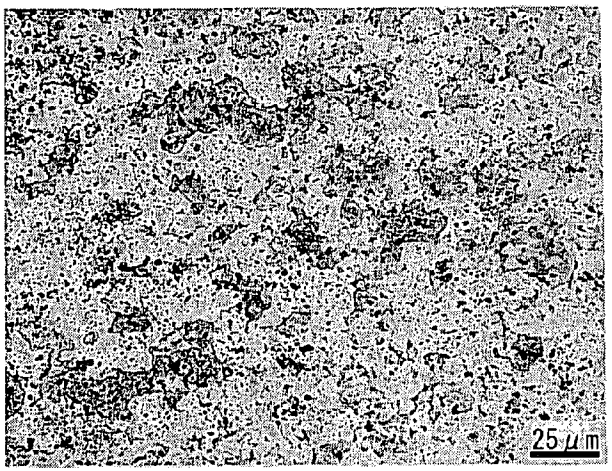

The optical microscopic photographs of metallographic structures of the test materials after the heat treatment are shown in FIG. 1 (T14, MM13, T3 and T4) and FIG. 2 (T5, T6 and T7). As is apparent from an observation of these photographs, in some test materials grains have sufficiently grown by furnace cooling heat treatment, and in other test materials grains have not sufficiently grown. T3, T6 and T7 in which grain growth has occurred are a test material (T3) in which $Fe_2O_3$ is added to the basic composition and test materials (T6 and T7) in which $TiO_2$ is added in place of Ti. It might be thought that, because of the presence of a sufficient excess oxygen content which chemically combines with Ti in steel (T3) or because of the presence of $TiO_2$ in place of Ti (T6 and T7), it is possible in these test materials to suppress a decrease in the C concentration in the matrix due to the formation of the carbide TiC, with the result that the α to γ transformation during heat treatment and the grain growth in the succeeding furnace cooling heat treatment occur effectively.

On the other hand, T4 and T5 in which grain growth is slight are a test material (T4) in which the amount of added Ti is increased from the basic composition and a test material (T5) in which the amount of added Ti is also increased besides the addition of $Fe_2O_3$. In these test materials, it might be thought that the C concentration in the matrix decreases extremely because a large amount of Ti chemically combines with C to form a carbide (T4), or an excess oxygen content high enough to inhibit the chemical bonding of a large amount of Ti with C does not exist even though $Fe_2O_3$ is added (T5).

Incidentally, both MM13 and T14 have the basic composition and are equivalent in terms of composition. However, grains have grown in MM13 (excess oxygen content: 0.137%), whereas grain growth is slight in T14 (excess oxygen content: 0.110%). It might be thought that this is because, even with the same composition, the amount of oxygen included in steel in the process of the mechanical alloying treatment, succeeding heat treatment, etc. differs delicately, with the result that in the case of MM13, there is an excess oxygen content high enough for the chemical bonding with the Ti in steel.

Figure 3:
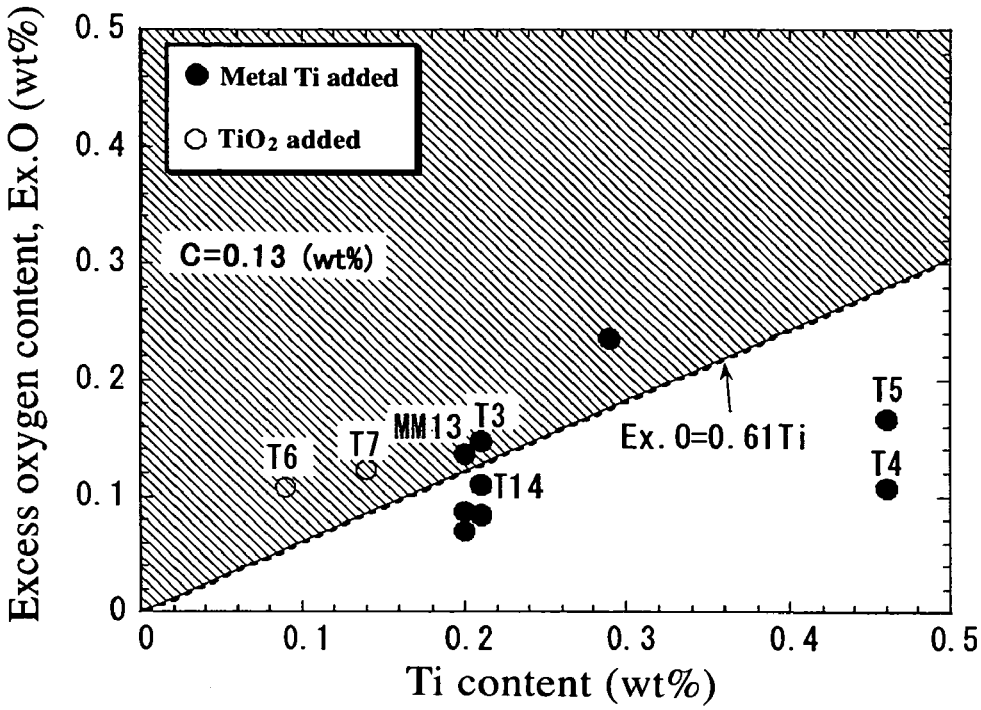
FIG. 3 is a graph showing the relationship between the Ti content and excess oxygen content (Ex.O) of each test material.

The graph of FIG. 3 shows the relationship between the Ti content and excess oxygen content of each test material. From this graph, it is understood that the coarsening of grains occurs due to furnace cooling heat treatment in the test materials MM13, T3, T6 and T7 which satisfy the relationship Ex.O>0.61Ti [Ex.O: excess oxygen content (%), Ti: Ti content in steel (%)].

The above-described results are all those of cases where the carbon content in steel is about 0.13%. The above-described Ex.O>0.61 Ti can be converted to the unit of molar quantity as follows:

$$Ex.O'(mol/g)>1.86Ti'\geqq 2Ti'(mol/g).$$

It may be considered that the coarsening≧ of grains occurs when there is an excess oxygen content high enough for all Ti in steel to be-able to form $TiO_2$ (i. e., when the C concentration remaining in the matrix is not less than 0.13%).

From the above-described results, it might be thought that, in the oxide dispersion strengthened ferritic steel of the present invention, if the C concentration remaining in the matrix for which the formation of $TiO_2$ and TiC is considered is not less than 0.13% ($1.08\times10^{-4}$ mol/g), sufficient α to γ transformation occurs during heat treatment and the coarsening of grains occurs due to furnace cooling heat treatment. The C concentration remaining in the matrix (C' r mol/g) for which the formation of $TiO_2$ and TiC is considered is expressed as follows:

$$C'r=C'-(Ti'-0.5Ex.O')$$

where C'r (mol/g): C concentration remaining in the matrix for which the formation of $TiO_2$and TiC is considered, C' (mol/g): C content in steel, Ti' (mol/g): Ti content in steel, Ex.O' (mol/g): Excess oxygen content in steel.

Hence, the conditional expression of grain coarsening is as follows:

$$C'r=C'-(Ti'-0.5Ex.O')\geqq 1.08\times10^{-4}$$

When the above equation is rearranged by converting the unit from mol/g to %, the following equation is obtained:

$$Ex.O>0.67Ti-2.7C+0.35$$

Excess oxygen is an important element which combines with metal Ti and $Y_2O_3$ to form fine complex oxides and simultaneously suppresses the bonding of the C with Ti in the matrix, thereby ensuring a sufficient C concentration in the matrix. However, excess oxygen of not less than 0.67 Ti −2.7C+0.45 remarkably inhibits dispersed particles from being finely dispersed and highly densified. The higher excess oxygen causes a remarkable decrease in toughness and simultaneously enhances the formation of inclusions with small amounts of Si, Mn, etc. Therefore, the upper limit value of the excess oxygen content should be 0.67Ti−2.7C+0.45.

Figure 4:
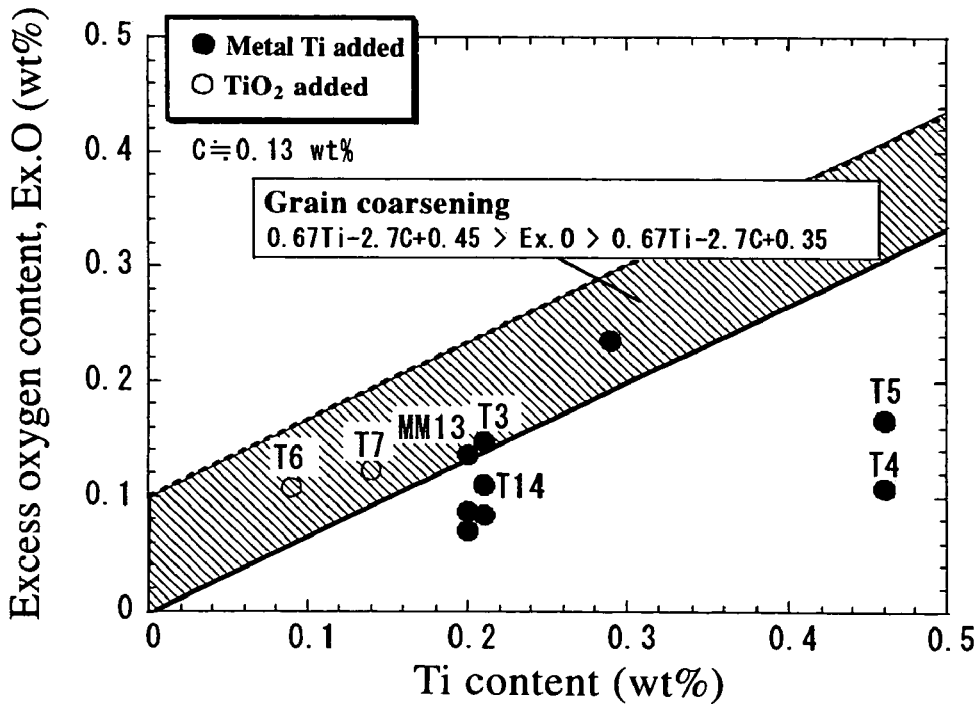
FIG. 4 is a graph in which the region satisfying the conditional expression of grain coarsening is indicated in the graph of FIG. 3 by a diagonally shaded portion.

The graph of FIG. 4 shows the range of the upper limit and lower limit to the above-described conditional expression of grain coarsening by a diagonally shaded portion in a plot of measured values of each test material. The conditional expression makes calculations on the basis of a C content of 0.13% and the test materials MM13, T3, T6 and T7 in which grains have grown are all in the diagonally shaded portion, whereas the test materials MM14, T5 and T4 in which grains have not grown are all outside the diagonally shaded portion. This demonstrates that this conditional equation is valid. Incidentally, it has been ascertained that, also in plots in the graph of FIG. 4 to which a test material number is not given, the coarsening of grains has occurred in test materials within the diagonally shaded portion and the coarsening of grains has not occurred in test materials outside the diagonally shaded portion.

For the reason described in detail above, in the present invention, when the excess oxygen content in steel is increased by additionally adding an $Fe_2O_3$ powder as a raw material powder to be mixed at the mechanical alloying treatment, the $Fe_2O_3$ powder is added so that the excess oxygen content in steel satisfies the following conditional expression of grain coarsening:

$$0.67Ti-2.7C+0.45>Ex.O>0.67Ti-2.7C+0.35$$

TEST EXAMPLE

<High-temperature Creep Rupture Test>

Test materials in which grains were coarsened (T3 (FC material) and T7 (FC material)) were prepared by subjecting the test materials T3 and T7 to the heat treatment according to the present invention, i.e., austenitization heat treatment (heating to a temperature of not less than the $Ac_3$ transformation point and holding at this temperature: 1050° C.×1 hr) and succeeding furnace cooling heat treatment (slow cooling heat treatment at a rate of not more than a ferrite-forming critical rate: slow cooling from 1050° C. to 600° C. at a rate of 37° C./hr).

Apart from these test materials, test materials in which grains were finely transformed (T14 (NT material), T3 (NT material) and T7 (NT material)) were prepared by subjecting the test materials T14, T3 and T7 to normalizing heat treatment (1050° C.×1 hr, air cooling (AC)) and succeeding tempering heat treatment (780° C.×1 hr, air cooling (AC)).

Figure 5:
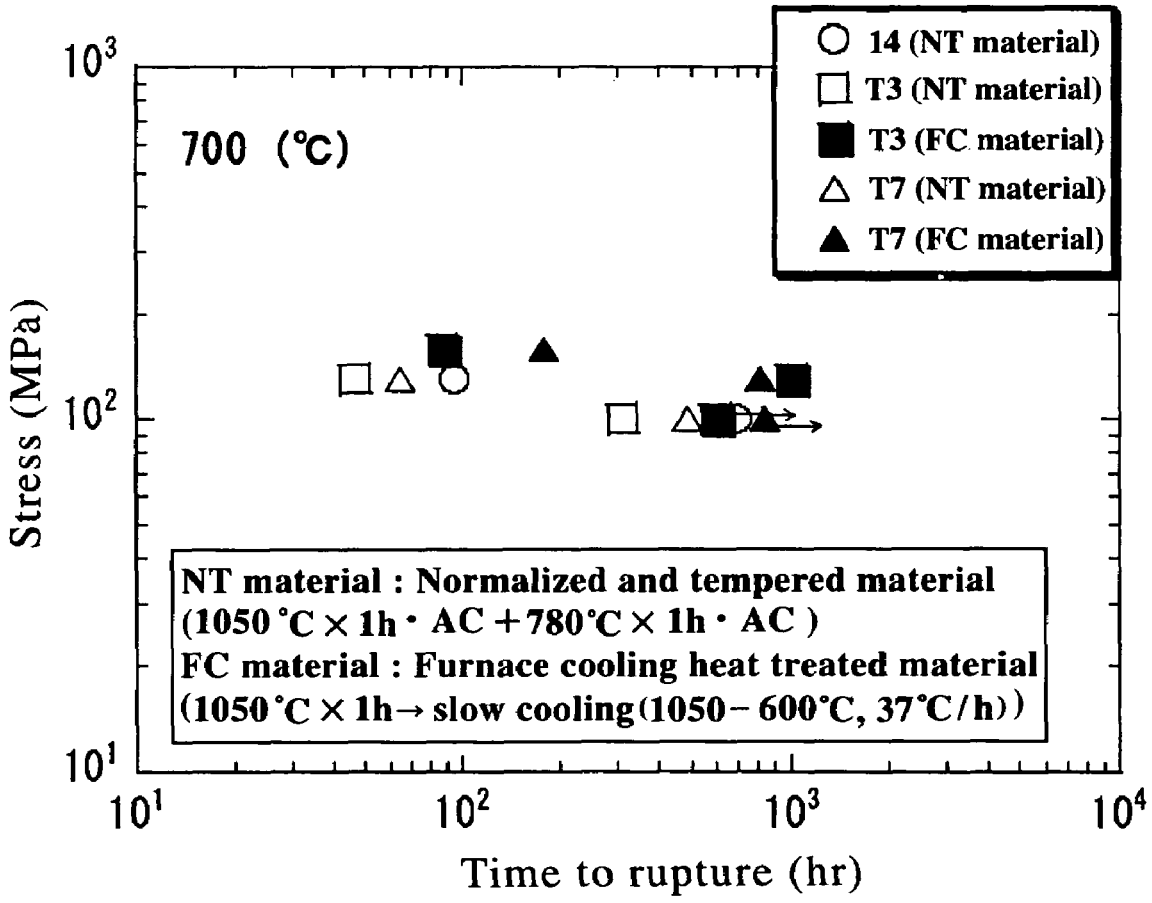
FIG. 5 is a graph showing the results of a high-temperature creep rupture test at 700° C. of the test materials T14, T3 and T7.

The graph of FIG. 5 shows the results of a uniaxial creep rupture test of these test materials which was conducted at a test temperature of 700° C. From the graph of FIG. 5, it is understood that high-temperature creep strength of T3 (FC material) in which the excess oxygen content was increased by additionally adding an $Fe_2O_3$ powder and grains were coarsened by furnace cooling heat treatment and T7 (FC material) in which a $TiO_2$ powder was used in place of a metal Ti powder and grains were coarsened by furnace cooling heat treatment is improved in comparison with other test materials.

INDUSTRIAL APPLICABILITY

As is apparent from the above descriptions, according to the present invention, even when Ti is added to an oxide dispersion strengthened ferritic steel, it is possible to ensure sufficient $\alpha$ to $\gamma$ transformation during heat treatment by suppressing the bonding of Ti with C to thereby maintain the C concentration in the matrix, and this enables coarsened grains to be formed. As a result, it is possible to obtain an oxide dispersion strengthened ferritic steel having excellent high-temperature creep strength.

The invention claimed is:

1. A method of manufacturing an oxide dispersion strengthened ferritic steel excellent in high-temperature creep strength having a coarse grain structure, said method comprising mixing either element powders or alloy powders and a $Y_2O_3$ powder, subjecting the mixed powder to mechanical alloying treatment, subjecting the resulting alloyed powder to hot extrusion, and subjecting the resulting extruded material to final heat treatment involving heating to and holding at a temperature of not less than the $Ac_3$ transformation point and slow cooling at a rate of not more than 100° C./hr to thereby manufacture an oxide dispersion strengthened ferritic steel which comprises, as expressed by % by weight, 0.05 to 0.25% C, 8.0 to 12.0% Cr, 0.1 to 4.0% W, 0.1 to 1.0% Ti, 0.1 to 0.5% $Y_2O_3$ with the balance being Fe and unavoidable impurities and in which $Y_2O_3$ particles are dispersed in the steel, wherein a $Fe_2O_3$ powder is additionally added as a raw material powder to be mixed at the mechanical alloying treatment so that an excess oxygen content in the steel (a value obtained by subtracting an oxygen content in $Y_2O_3$ from an oxygen content in steel) satisfies $$0.67Ti-2.7C+0.45>Ex.O>0.67Ti-2.7C+0.35$$

where Ex.0: excess oxygen content in steel, % by weight,

Ti: Ti content in steel, % by weight,

C: C content in steel, % by weight.

2. The method of manufacturing an oxide dispersion strengthened ferritic steel according to claim 1, wherein the slow cooling is carried out in a furnace.

* * * * *